United States Patent [19]

Frisbee

[11] 4,211,282

[45] Jul. 8, 1980

[54] ADJUSTABLE BLADE STABILIZER AND CONTROLS

[75] Inventor: Claude M. Frisbee, Bettendorf, Iowa

[73] Assignee: J. I. Case Company, Racine, Wis.

[21] Appl. No.: 953,740

[22] Filed: Oct. 23, 1978

[51] Int. Cl.[2] ..... E02F 3/76

[52] U.S. Cl. ..... 172/7; 172/809; 280/446 R

[58] Field of Search ..... 172/802, 809, 801, 804, 172/805, 803, 807, 2, 7, 4; 280/479, 468, 460 A, 446 A, 446 R

[56] References Cited

U.S. PATENT DOCUMENTS

| | | | |
|---|---|---|---|
| 3,002,300 | 10/1961 | Turbyfill | 172/804 |
| 3,441,092 | 4/1969 | Drone | 172/803 |
| 3,734,195 | 5/1973 | Cantral | 172/7 |
| 3,897,833 | 8/1975 | Frisbee | 172/809 |
| 3,901,329 | 8/1975 | Eftefield | 172/809 |
| 3,941,195 | 3/1976 | Stedman | 172/809 |

*Primary Examiner*—Richard J. Johnson
*Attorney, Agent, or Firm*—Cullen, Sloman, Cantor, Grauer, Scott & Rutherford

[57] ABSTRACT

An adjustable blade stabilizer and controls utilized in an earth-working machine such as a bulldozer. The blade and push arms of the machine form a U-shaped structure which is unable to adjust to substantial lateral loads imposed on the blade. The blade stabilizer of the present invention interconnects the front of the frame and either the rear of the blade or one of the push arms. The lift cylinders for the blade are mounted in trunnion assemblies for pivotal movement about mutually perpendicular axes. One of the lift cylinders has associated therewith controls for actuating the stabilizing cylinder in response to lateral forces imposed on the blade. Movement of the control lift cylinder as a result of lateral movement of the blade is sensed by a position switch mounted in the side wall of the main frame which actuates a selection valve thereby causing fluid pressure to be applied at either the head end or rod end of the stabilizing cylinder to stabilize the blade. A semi-circular position plate connecting the lift cylinder and position switch causes the position switch to be linearly moved in response to pivotal movement of the lift cylinder. The position switch causes the selection valve to be shifted whereby the stabilizing cylinder is extended or retracted to counteract the laterally imposed forces on the blade.

9 Claims, 6 Drawing Figures

FIG. 2α

ADJUSTABLE BLADE STABILIZER AND CONTROLS

BACKGROUND OF THE INVENTION

The present invention relates to bulldozers or the like having transversely extending blades, and more particularly to a blade stabilizing linkage and controls therefore mounted between the vehicle and bulldozer blade for resisting side loading and lateral stresses applied to the blade.

The blade of many earth-working vehicles is typically pivotally mounted forwardly of the front end of the main frame or push arms which extend rearwardly and flank the track frames. The push arms are pivotally connected to the track frames near the rear of the vehicle. The problem of resisting side loading upon bulldozer blades is well-known in the prior art and a number of stabilizing linkages have been proposed as solutions.

It is conventional practice to provide diagonal braces extending between the push arms and the back of the blade for resisting such side loads. These diagonal braces typically prevent the blade from being mounted close to the tractor by requiring substantial spacings between the blade and the vehicle which is undesirable. These prior art devices have required that the blade be positioned sufficiently forward to provide the necessary clearance with the forward ends of the tracks for the blade to be raised and lowered. There has been a need for a stabilizing linkage capable of resisting side loads while permitting the blade to be mounted close to the forward end of the tractor thereby improving machine stability and manueverability.

There are many instances where off-center loading of the blade occurs such as when the tractor is operating against a side hill. Large forces that can cause lateral shifting of the blade also occur when the vehicle is changing direction and the blade is engaged with the earth. The push arms and blade form a U-shaped structure which is not adjustable to withstand side loads. The spacing between the push arms and adjacent track frames must be maintained or possible contact between the push arms and track can result. There has been a need for a stabilizer link which prevents appreciable sidewise motion of the blade to the point that contact between the push arms and track occurs with resulting damage or injury.

The prior art stabilizing linkages have prevented other desirably features in connection with blade mounting and movement on the tractor. Many such linkages cannot be adapted to permit vertical, tilting, and angling movement of the blade relative to the vehicle frame without undesirably increasing the clearance between the track frames, push arms, and blade which adversely affects the overall length of the machine and its balance.

Another problem associated with prior art stabilizing linkages is that they are not adequately adjustable or controlled to compensate for the various degrees of off-center loading in the blade. The stabilizing link should also be capable of resisting lateral forces imposed on the blade at any vertical position of the blade. To resist the lateral loads imposed by off-center operation of the tractor, the prior art braces have been extremely bulky, relatively complex, and expensive to provide maximum resistance to the side loads. It is not unusual that larger than expected loads are encountered which cause the braces to fail, thereby requiring larger and more expensive replacement configurations. There has been a need for an adjustable stabilizer link that is controlled to respond when various degrees of lateral load are imposed on the bulldozing blade and when the blade assumes various vertical positions.

These disadvantages of present bulldozer stabilizer linkages have resulted in the stabilizing linkage and controls therefore in the present invention which is capable of resisting side loads upon the blade and also permitting close coupling of the blade relative to the machine upon which it is supported.

SUMMARY OF THE INVENTION

The adjustable blade stabilizer and controls of the present invention may be utilized in a conventional bulldozer wherein the blade and push arms thereof form a U-shaped structure which is unable to adjust to substantial side loads. The bulldozer includes a conventional transverse scraper blade carried at the forward ends of laterally spaced push arms which flank the track frames and are independently pivoted to the frames. The blade is rasied and lowered by conventional hydraulic actuators supported on opposite sides of the engine housing and having piston rods pivotally connected to the back of the blade.

It is the principal object of the invention to provide a single adjustable blade stabilizer and controls interconnected between the bulldozing blade and the frame of the tractor to absorb severe transverse forces such as encountered when an end of the blade contacts a stationary object. Large clearances are not necessary between the blade, track frames and push arms, and the blade stabilizer system of the present invention does not interfere with ordinary blade adjustments. The blade stabilizer is controlled to counteract lateral loads imposed on the blade, and it provides for the transfer of the lateral loads to and through the main frame of the tractor.

In the preferred embodiment of the invention, a single blade stabilizing cylinder is located between the forward end of the tractor and the blade, and it extends transverse of the tractor to act as a rigid brace between the main frame and bulldozer blade thereby preventing appreciable sidewise motion of the blade. A second embodiment of the invention includes the identical stabilizer cylinder system extending transversely of the tractor in substantially parallel relationship with the blade to be pivotally connected between the forward end of the tractor and one push arm thereby providing a compact arrangement wherein the blade may be positioned closer to the tractor.

The present invention utilizes an extensible and retractable stabilizer cylinder which is actuated to resist the lateral movement of the blade in response to a control system associated with one of the lift cylinders. The lift cylinders for vertically lifting the blade are secured within trunnion assemblies for pivotal movement about mutually perpendicular axes, and one of the lift cylinders has associated therewith control means for actuating the stabilizing cylinder in response to lateral forces imposed on the blade. Lateral shifting of the blade causes a pivotal movement by the lift cylinders within their trunnion mountings. Movement of one of the lift cylinders is sensed by a position switch mounted in the side wall of the main frame which actuates a solenoid valve thereby causing fluid pressure to be applied at either the head end or rod end of the cylinder to correct the position of the blade and keep it stable.

The position switch which is linearly movable in response to pivotal movement of the control lift cylinder includes a sliding contact plunger having a bifurcated portion at one end which is in sliding engagement with a semi-circular position plate mounted on a cylindrical portion of the lift cylinder. When the blade is subjected to side loading, the lift cylinder having the semicircular position plate mounted thereon is similarly pivoted about one of its axes. The semi-circular position plate connecting the lift cylinder and position switch causes the position switch to be linearly moved in response to the pivotal movement of the lift cylinder. The position switch actuates a solenoid which shifts a selector valve whereby the stabilizer cylinder is extended or retracted to counteract the laterally imposed forces on the blade.

The control system for actuating the stabilizing cylinder is operative for all vertical positions of the blade. The position switch is mounted in the side wall of the main frame such that it lies on a line parallel to the centerline of the control lift cylinder with the blade at ground level. The position plate, which transmits control movement from the pivotal control lift cylinder to the position switch, is semi-circular in shape so that it can slidably engage and still move with respect to the position switch as the lift cylinder changes its attitude. Thus, lateral forces imposed on the blade at any vertical position will be sensed by the controls associated with the one lift cylinder and counteracted by actuation of the stabilizing cylinder.

Other advantages and meritorius features of the adjustable blade stabilizer and controls of the present invention will be more fully understood from the following description of the preferred embodiments, the appended claims, and the drawings. A brief description of which follows.

BRIEF DESCRIPTION OF THE DRAWINGS

FIG. 2*a* is an enlarged, fragmentary top elevation of the controls for actuating the stabilizing cylinder;

DESCRIPTION OF THE PREFERRED EMBODIMENTS

Figure 1:
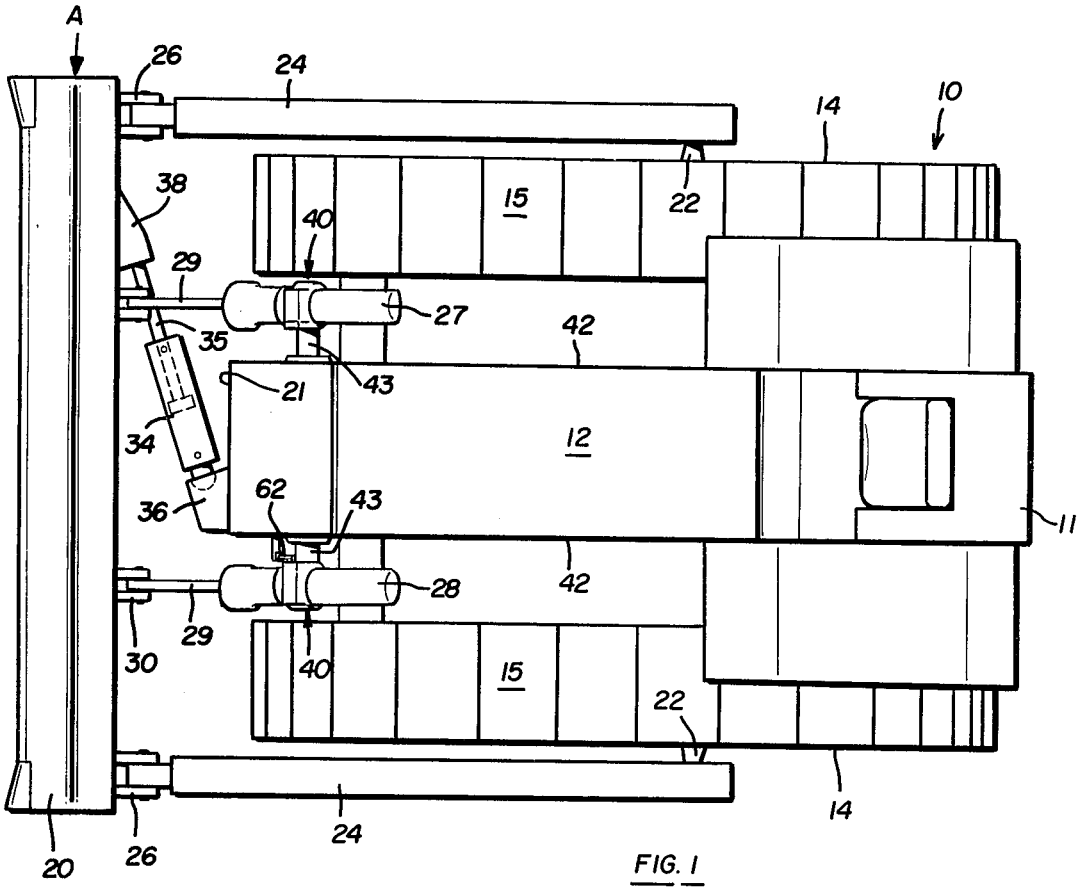
FIG. 1 is a plan view of an earth-working vehicle embodying the invention.
Figure 4:
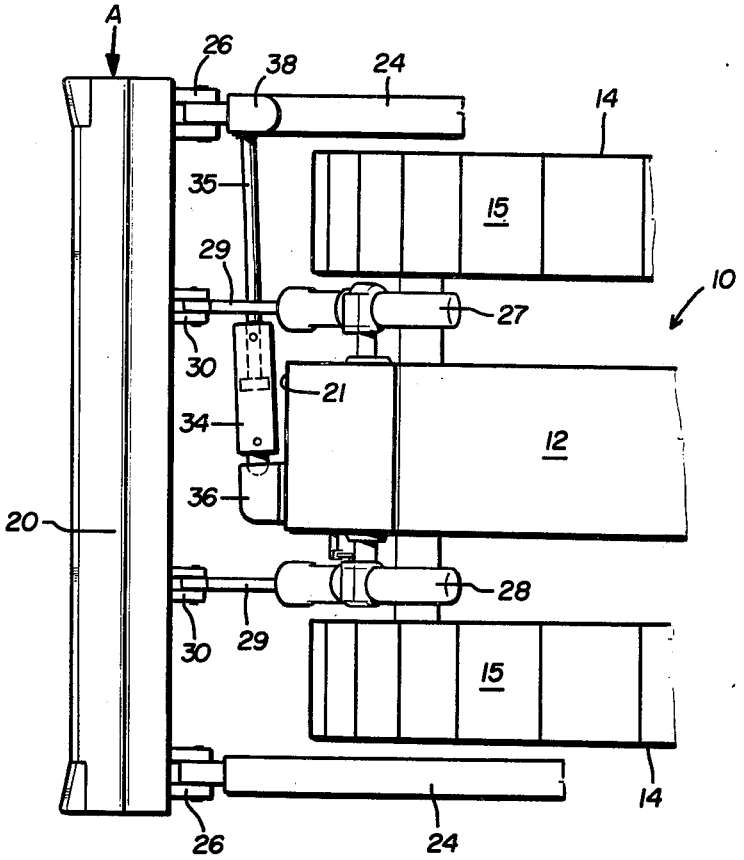
FIG. 4 is a plan view of the earth-working vehicle illustrating a compact arrangement wherein the stabilizer cylinder extends transversely of the tractor in substantially parallel relationship with the blade.

A bulldozer blade mounted on an earth-working vehicle and having one embodiment of the adjustable blade stabilizer of the present invention is shown in FIG. 1. A second embodiment is shown in FIG. 4, and it will be understood that the blade stabilizer may be utilized in other implements having the prior art problems described hereinabove. For example, the stabilizer linkage may be utilized in a wheeled vehicle or tractor. The following description will be limited to a bulldozer of the type shown for simplicity of illustration.

Figure 2B:
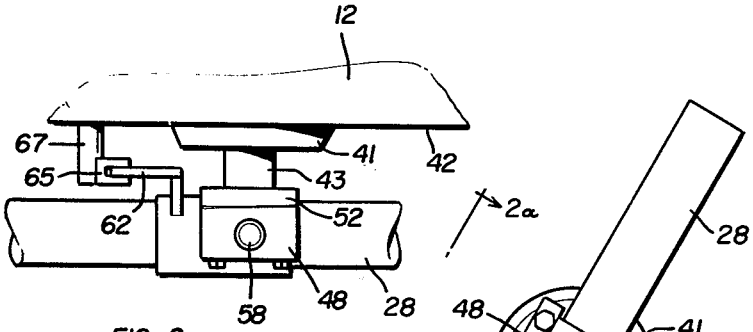
FIG. 2*b* is an enlarged, fragmentary side elevation of the controls illustrated in FIG. 2*a;*
Figure 2B:
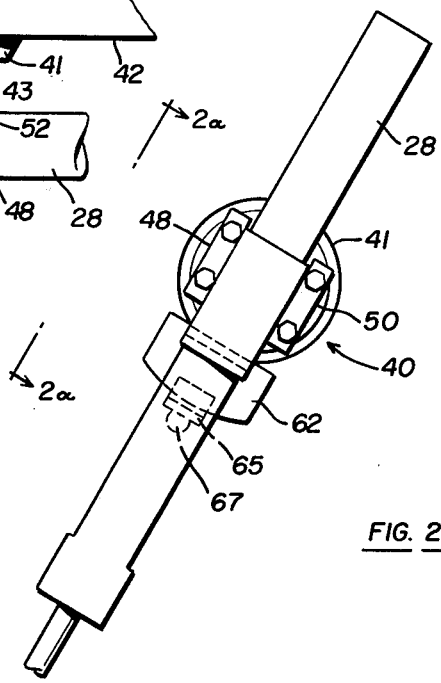
Figure 3:
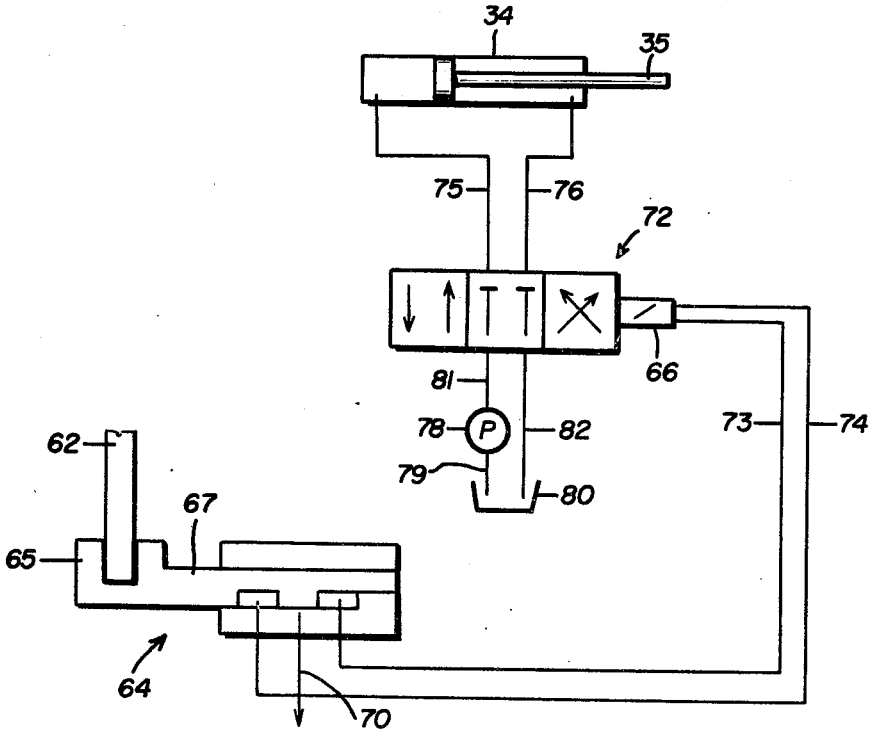
FIG. 3 is a schematic illustration of the stabilizing blade control system incorporating the principles of the invention.

A preferred embodiment of an earth-working vehicle including an adjustable blade stabilizer made in accordance with the teachings of the present invention is illustrated in FIGS. 1–3. The tractor 10 shown in FIG. 1 is seen to include an operator's station generally indicated at 11 and a main frame 12 flanked by a pair of drive track frames 14. As is well known, track roller assemblies (not shown) may be provided on each of the track frames 14 for engaging track chains 15.

The bulldozer includes a conventional transverse scraper blade 20 mounted forwardly of the front end 21 of the frame 12. The blade 20 is carried at the forward ends of laterally spaced push arms 24 which flank the track frames 14 and are independently pivoted by universal joints 22 to the conventional track roller frames 14. The blade 20 is secured to the push arms 24 by means of a pair of clevis type connections 26 located near the lower end of the blade and on the back side thereof. As will be recognized by those skilled in the art, the connections 26 provide for pivotal mounting of the blade 20 on the push arms 24 for movement about a horizontal axis. The blade 20 is raised and lowered by conventional hydraulic actuators or lift cylinders 27 and 28 supported on opposite sides of the engine housing and having piston rods 29 pivotally connected to lugs 30 mounted to the back of the blade.

The present invention utilizes a single extensible and retractable stabilizer cylinder 34 universally interconnected between the tractor and bulldozer blade 20. The single blade stabilizer is entirely located between the forward end of the tractor and the blade, and it extends transversely of the tractor as illustrated in FIG. 1. Still another form of blade stabilizer embodying the invention is illustrated in FIG. 4. According to the embodiment of FIG. 4, the blade stabilizer extends transversely of the tractor in substantially parallel relationship with the blade to provide a more compact arrangement which provides an added advantage of permitting the blade to be positioned closer to the tractor as will be subsequently described.

In both embodiments, the cylinder portion of the stabilizer assembly is pivotally coupled to the forward portion of the main frame 12 by means of a ball and socket joint 36. Piston rod 35 of the blade stabilizer 34 is pivotally coupled to the blade 20 by means of ball and socket joint 38 as illustrated in FIG. 1, or it is pivotally coupled to one of the push arms 24 as illustrated in FIG. 4. Stabilizer link 34 acts as a rigid brace between the main frame and the bulldozer blade to prevent undesirable side or lateral motion of the blade.

Figure 5:
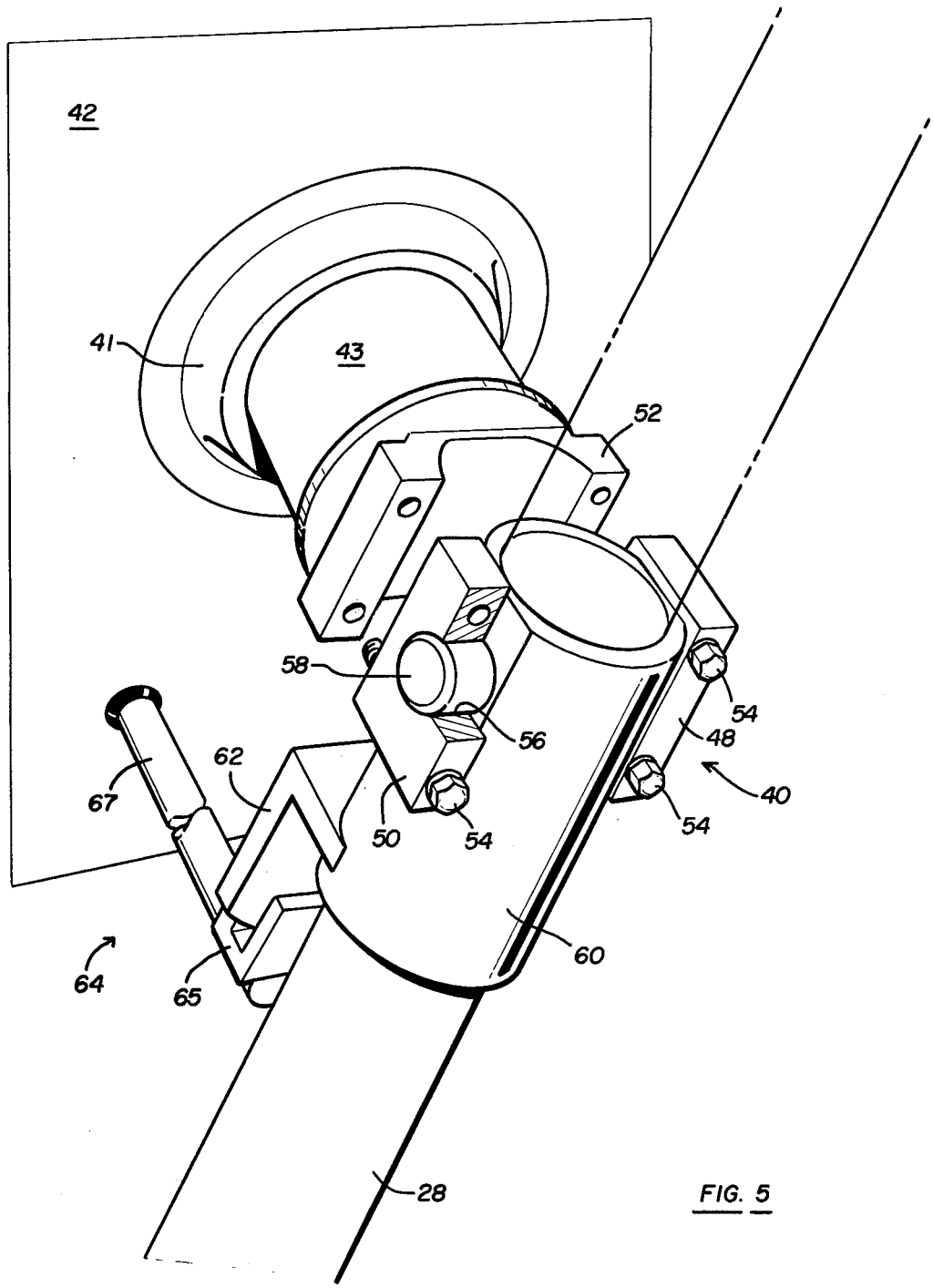
FIG. 5 is an enlarged perspective view of the controls for the stabilizer cylinder.

FIGS. 2*a*, 2*b*, and 5 illustrate the cylinder trunnion mounting 40 which forms part of the present invention. Hydraulic lift cylinders 27 and 28 are suitably secured within the trunnion assembly and include hydraulic piston rods 29 for lifting and lowering bulldozing blade assembly 20. As illustrating, piston rods 29 are pivotally connected to the rear of blade 20 by boss and pin connections 30.

The trunnion assembly includes an outer race 41 which is rigidly and permanently secured to the supporting side wall 42 of the tractor main frame 12. Bearing elements (not shown) within the raceway permit rotational movement of stub shaft 43 about a rotational axis perpendicular to the raceway. Mounting blocks 48 and 50 are releaseably secured to attachment face 52 by a plurality of bolts 54 fitted into appropriate bores in the mounting blocks 48, 50. Each mounting block includes a circular bore 56 extending through the block width to rotationally receive and support diametrically opposed stub shafts 58 of hydraulic mounting cylinder ring 60. The hydraulic lift cylinders 27 and 28 are secured to mounting cylinder rings 60, for example, by heat shrinking or welding.

The hydraulic lift cylinders have complete freedom of movement in any direction. For example, they may rotate about an axis perpendicular to the supporting side wall structure due to the ball bearing raceway structure 41, and they may rotate about an axis perpendicular to the rotational axis of the raceway as a result of the rotational connection between the stub shafts 58 and mounting blocks 48, 50.

A lateral shifting of blade 20 causes a pivotal movement of the lift cylinders 27 and 28 about the axes of stub shafts 58. One of the lift cylinders 28, as illustrated in FIGS. 1, 2*a*, and 5, has a semi-circular position plate 62 welded or otherwise secured on the lower end of the lift cylinder mounting ring 60 such that pivotal movement by the lift cylinder 28 causes position plate 62 to actuate a position switch 64 mounted on the side wall of main frame 12. The actuation of position switch 64 sends a signal to the solenoid valve 66 illustrated in FIG. 3 which causes fluid pressure to be applied at the proper end of the stabilizer cylinder 34 thereby correcting the position of the blade and keeping it stable.

From the foregoing, it will be recognized that lateral movement of the bulldozing blade 20 causes the control lift cylinder 28 to pivot about stub shafts 58 and through semi-circular position plate 62 actuate position switch 64 which in turn sends a signal to the solenoid valve 66 thereby correcting the position of the blade. The position switch 64 is mounted within the side wall of main frame 12 on a line that is parallel to the lift cylinder centerline with the blade 20 at ground level.

The semi-circular position plate 62 is slidable within the bifurcated yoke portion 65 of position switch 64 such that pivotal movement by the control lift cylinder 28 is translated into linear movement of the position switch 64 at all elevational positions of the blade. The semi-circular shape of position plate 62 permits the lift cylinder 28 to pivot about the rotational axis of the raceway 41 and still engage the plunger 67 of switch 64 for all elevational positions of the blade. The fit between plate 62 and bifurcated portion 65 of plunger 67 is such that pivotal movement of plate 62 about an axis perpendicular to the rotational axis of the raceway will be translated to linearly move the plunger without binding.

With reference to FIG. 3, the position switch 64 includes a sliding contact plunger 67 having a bifurcated yoke portion 65 at one end which is in sliding engagement with the semi-circular position plate 62 mounted on the lift cylinder mounting ring 60. The position switch is suitably connected by conduit 70 to a source of current which may be the battery of machine in which the present system is embodied.

The selector valve 72 illustrated in FIG. 3 is provided with actuator 66 which may be a solenoid connected by conduits 73 and 74 to conductive areas (not shown) in the position switch 64. As the sliding contact plunger 67 is moved linearly in response to the pivotal movement of control lift cylinder 28, the source of current through conduit 70 is either connected through conduit 73 or 74. Thus, the sliding movement of plunger 67 in response to lateral shifting of blade 20 will actuate solenoid 66 thereby shifting selector valve 72 and causing transmission of fluid through either fluid conduit 75 or 76.

It will be appreciated to those skilled in the art that position switch 64 is only illustrative of one type of switch that can be used to energize the selector valve 72. It is within the scope of the invention to provide other apparatus for sensing the pivotal movement of the control lift cylinder 28 and in response thereto shift the selector valve 72 accordingly.

Referring to FIG. 3, the hydraulic circuitry illustrated has a pressure fluid source, such as a pump 78 with its inlet 79 connected to a reservoir 80. The pump 78, when operative, supplies fluid under pressure to its outlet denoted generally at 81. Connected to the outlet 81 is the selector valve 72, and this selector valve is adjustable to connect the outlet 81 either to supply line 75 or supply line 76 extending to the head end and rod end of the stabilizer cylinder 34, respectively.

The selector valve 72 can be adjusted to supply pressure fluid by way of supply line 75 while connecting the other supply line 76 to the reservoir 80 by way of discharge line 82. Depending on whether fluid pressure is supplied to the head end or rod end of the stabilizer cylinder 34, the piston and rod assembly 35 is either extended or retracted. As explained, the stabilizing cylinder is either extended or retracted responsive to lateral shifting of the blade for the purpose of stabilizing the blade, correcting the position of the blade, and keeping the pushbeams substantially parallel to the tracks.

With no lateral shifting of the blade, the selector valve 72 is in its neutral setting and both fluid supply conduits 75 and 76 are disconnected from the pump outlet 81 and discharge line 82.

Still another embodiment of the stabilizer linkage is illustrated in FIG. 4. According to the embodiment of FIG. 4, the stabilizer cylinder 34 extends transversely of the tractor in substantially parallel relationship with the blade. This compact arrangement resists the laterally imposed forces imposed on the blade, as with the embodiment illustrated in FIG. 1, and it has the added advantage of permitting the blade to be positioned closer to the tractor.

In the operation of the invention, when the blade 20 is subjected to side loading as shown by the load indicating arrow A, the control lift cylinder 28 is pivoted about the axes of its stub shafts 58 which linearly moves sliding contact plunger 67 of position switch 64 to a position whereby the solenoid 66 is actuated. The selector valve 72 is shifted by solenoid 66 into a position such that fluid pressure is supplied through fluid conduit 75 to the head end of stabilizer line 34. Extension of piston and rod assembly 35 from stabilizer link 34 counteracts the lateral side load imposed in the direction of arrow A. Thus, the lateral load imposed on blade 20 in the direction of arrow A is substantially directly transmitted by the stabilizer cylinder 34 to the tractor main frame 12, and in turn, the load is passed on to the track frames 14. If the side load forces the blade to move laterally in a direction opposite to arrow A, the lift cylinder 28 is again pivoted about the axes of stub shafts 58 resulting in the retraction of the piston and rod assembly 35 of the stabilizer cylinder 34. It will be recognized that the stabilizing means of the present invention provides substantial resistance to lateral movement by the blade due to the stresses encountered in operation, and yet it accommodates blade movement with respect to the frame.

It will apparent to those skilled in the art that the foregoing disclosure is exemplary in nature rather than limiting, the invention being limited only by the appended claims.

I claim:

1. In an earth-working vehicle having a frame, a pair of push arms pivotally secured at one of their ends to said frame and a blade pivotally secured to the push arms at their other ends, a pair of lift cylinders pivotally interconnected between said frame and said blade, the improvement comprising:

an extensible and retractable blade stabilizer pivotally secured to the frame front end and operatively connected to said blade;

control means operably connected with at least one of said lift cylinders and responsive to lateral movement of said blade to extend or retract said blade stabilizer thereby resisting relative lateral movement between said blade and said frame front end;

means for mounting said lift cylinders on opposed sides of said frame front end, said mounting means permitting pivotal movement by said lift cylinders about two mutually perpendicular axes, each lift cylinder being pivotal about a first axis perpendicular to the longitudinal axis of said vehicle and each lift cylinder being pivotal about a second axis perpendicular to said first axis, said lift cylinders being pivotal about said second axes in response to lateral movement of said blade, and said control means being responsive to pivotal movement by one of said lift cylinders for actuating said blade stabilizer to resist lateral movement of said blade.

2. In an earth-working vehicle having a frame, a pair of push arms pivotally secured at one of their ends to said frame and a blade pivotally secured to the push arms at their other ends, a pair of lift cylinders pivotally interconnected between said frame and said blade, the improvement comprising:

an extensible and retractable blade stabilizer pivotally secured to the frame front end and operatively connected to said blade;

control means operably connected with at least one of said lift cylinders and responsive to lateral movement of said blade to extend or retract said blade stabilizer thereby resisting relative lateral movement between said blade and said frame front end;

said lift cylinders are mounted in trunnion bearings on opposed sides of said frame front end permitting pivotal movement by said lift cylinders about two mutually perpendicular axes, each lift cylinder being pivotal about a first axis perpendicular to the longitudinal axis of said vehicle and each lift cylinder being pivotal about a second axis perpendicular to said first axis, said lift cylinders being pivotal about said second axes in response to lateral movement of said blade, said control means responsive to pivotal movement by one of said lift cylinders for actuating said blade stabilizer to resist lateral movement of said blade.

3. The blade stabilizer as defined in claim 1 wherein said blade stabilizer being universally connected at one end to said frame front end, said stabilizer extending transversely on said frame front end substantially parallel to said blade and being universally connected at its other end to one of said push arms thereby providing a compact arrangement whereby the blade may be positioned relatively close to said frame front end.

4. The blade stabilizer as defined in claim 2 wherein said one lift cylinder having a position plate means mounted on a cylindrical portion of said lift cylinder for pivotal movement about said two mutually perpendicular axes, said plate means being engageable with position switch means mounted in the side wall of said frame front end, said plate means actuating said position switch means in response to lateral movement of said blade which causes said lift cylinder and plate means to pivot about said second axis.

5. The blade stabilizer as defined in claim 4 wherein said plate means is engageable with said position switch means during all elevational positions of said blade.

6. The blade stabilizer as defined in claim 5 wherein said position plate means is semi-circular in shape.

7. The blade stabilizer as defined in claim 4 wherein said position switch means having a sliding contact plunger mounted for linear movement within said side wall of said frame front end, said plunger having a yoke portion on one end thereof that is engageable with said position plate means, said plunger movable linearly in response to pivotal movement by said lift cylinder and position plate means about said second axis, a selector valve actuated by said linear movement of said plunger, said selector valve movable to transmit fluid pressure to said blade stabilizer for extending or retracting said stabilizer in response to lateral movement of said blade.

8. The blade stabilizer as defined in claim 4 wherein said position switch is mounted in said side wall of said frame front end such that it lies on a line parallel to the center line of said one lift cylinder when said blade is at ground level.

9. In an earth-working vehicle having a frame, a pair of arms pivotally secured at one of their ends to said frame and a blade pivotally secured to the arms at their other ends, a pair of lift cylinders pivotally interconnected between said frame and said blade, the improvement comprising:

an extensible and retractable blade stablizer pivotally secured to the frame front end and operatively connected to said blade;

control means operably connected with at least one of said lift cylinders and responsive to lateral movement of said blade to extend or retract said blade stabilizer thereby resisting relative lateral movement between said blade and said frame front end;

said lift cylinders are mounted in trunnion bearings on opposed sides of said frame front end permitting pivotal movement of said lift cylinders about two mutually perpendicular axes, each lift cylinder being pivotal about a first axis perpendicular to the longitudinal axis of said vehicle and each lift cylinder being pivotal about a second axis perpendicular to said first axis, said lift cylinders being pivotal about said second axes in response to lateral movement of said blade, said control means including position switch means which is actuated in response to pivotal movement by one of said lift cylinders about said second axis for actuating said blade stabilizer to resist lateral movement of said blade.

* * * * *